US007665307B2

(12) United States Patent
Burd et al.

(10) Patent No.: US 7,665,307 B2
(45) Date of Patent: Feb. 23, 2010

(54) DUAL WALL COMBUSTOR LINER

(75) Inventors: Steven W. Burd, Cheshire, CT (US); Stephen K. Kramer, Cromwell, CT (US); John T. Ols, Coventry, CT (US)

(73) Assignee: United Technologies Corporation, Hartford, CT (US)

( * ) Notice: Subject to any disclaimer, the term of this patent is extended or adjusted under 35 U.S.C. 154(b) by 622 days.

(21) Appl. No.: 11/316,657

(22) Filed: Dec. 22, 2005

(65) Prior Publication Data

US 2007/0144178 A1 Jun. 28, 2007

(51) Int. Cl.
*F02C 1/00* (2006.01)
*F02G 3/00* (2006.01)

(52) U.S. Cl. ..... 60/753; 60/752

(58) Field of Classification Search ..... 60/752, 60/753, 796, 800; 431/351, 352, 353
See application file for complete search history.

(56) References Cited

U.S. PATENT DOCUMENTS 4,030,875 A * 6/1977 Grondahl et al. ..... 60/753
5,438,834 A * 8/1995 Vuillamy et al. ..... 60/753
5,488,826 A * 2/1996 Paas ..... 60/299
6,182,451 B1 * 2/2001 Hadder ..... 60/732
6,223,538 B1 5/2001 Benz et al.
6,571,560 B2 6/2003 Tatsumi et al.
6,758,653 B2 7/2004 Morrison
6,890,660 B2 5/2005 Beyer et al.
7,237,389 B2 * 7/2007 Ryan et al. ..... 60/800
2005/0086940 A1 * 4/2005 Coughlan et al. ..... 60/752

* cited by examiner

*Primary Examiner*—Michael Cuff
*Assistant Examiner*—Andrew Nguyen
(74) *Attorney, Agent, or Firm*—Carlson, Gaskey & Olds

(57) ABSTRACT

A combustor liner assembly includes an outer shell made of a ceramic composite and an inner heat shell that is supported within the outer shell. The inner heat shield defines a surface that is exposed to combustion gases. The inner heat shield is made of material that is compatible with the ceramic matrix composite and that provides favorable thermal gradient capability for a combustion chamber.

15 Claims, 3 Drawing Sheets

DUAL WALL COMBUSTOR LINER

This invention was made with Government support under Contract Nos. F33615-98-C-2907 and F33615-01-C-2183 awarded by the United States Air Force. The Government has certain rights in this invention.

BACKGROUND OF THE INVENTION

This invention relates to a dual wall combustor for a gas turbine engine. More particularly, this invention relates to a dual wall combustor including a ceramic matrix composite shell that supports a liner assembly.

A combustor for a gas turbine engine includes an outer shell and an inner liner. The inner liner is directly exposed to combustion gases and defines a gas flow path. The inner liner is spaced apart from the outer shell to define an air-cooling passage for cooling and controlling the temperature of the inner liner. Both the inner liner and the outer shell are fabricated from a material capable of withstanding the extreme temperatures generated during the combustion process.

During operation, the inner liner is exposed to thermal gradients caused by the flow and swirl of the fuel air mixture as it is ignited to generate combustion gases. Such differences in temperature cause the thermal gradients within the inner liner. A design concern is providing an inner liner material and configuration that accommodates such gradients. As appreciated, not all materials that perform favorably at high temperatures can also withstand the thermal gradients and the strains produced by such differences in temperature. Disadvantageously, the stress and strains generated in the inner liner by the thermal gradients have complicated the use of many materials capable of withstanding the elevated temperatures produced during combustion.

One example material includes ceramic matrix composites. A ceramic matrix composite includes ceramic fibers interwoven into a sheet that is than impregnated with a material such as Silicon Carbide, Silicon-Nitride or other oxide components that are capable of withstanding elevated temperatures. As appreciated, higher temperatures within a combustor are favorable to provide a more efficient burning of fuel. However, the ceramic matrix composite does not respond favorably to thermal gradients and therefore has not been widely utilized in conventional combustors.

Accordingly, it is desirable to develop a combustor that utilizes the advantageous thermal properties of ceramic matrix materials within a combustor without compromising combustor strength and durability.

SUMMARY OF THE INVENTION

An example combustor for a gas turbine engine according to this invention includes an outer shell made of a ceramic matrix composite that supports a plurality of inner heat shields made of a material other than the ceramic matrix composite.

The combustor liner assembly of this invention includes an outer shell made from a ceramic matrix composite. The ceramic matrix composite is a thermally desirable material and provides the requisite thermal insulation between the combustor chamber and other elements within the gas turbine engine. Supported within the outer shell is a plurality of heat shields that are constructed of a material other than the ceramic matrix composite.

The ceramic matrix composite of the outer shell performs optimally at a substantially stable and uniform temperature. However, the ceramic matrix composite does not perform as desired or provide the desired durability when exposed to substantial thermal gradients such as are experienced within a combustor chamber. Therefore, the inner heat shields are fabricated from a material that provides favorable thermal mechanical properties compatible with the thermal gradients generated within a combustor chamber.

The inner heat shield is supported within the outer shell by a plurality of fasteners. The fasteners provide a mechanical coupling between the plurality of heat shields and the outer shell while also providing a thermal de-coupling between the inner heat shields and outer shell. The thermal de-coupling inhibits thermal transfer between the inner heat shields and the outer shell.

A cooling air passage is defined between the plurality of inner heat shields and the outer shell to provide cooling air along the inner heat shields. Cooling air is provided as impingement flow against a cold side of each of the heat shields and also maybe communicated to the hot side surface of the inner heat shields through the plurality of cooling holes.

Accordingly, the combustor liner assembly of this invention provides a structure that utilizes the favorable properties of a ceramic matrix composite material in portions of a combustor that are exposed to substantially uniform temperatures while also accommodating the thermal gradients present within a combustor liner assembly.

These and other features of the present invention can be best understood from the following specification and drawings, the following of which is a brief description.

DETAILED DESCRIPTION OF THE PREFERRED EMBODIMENT

Figure 1:
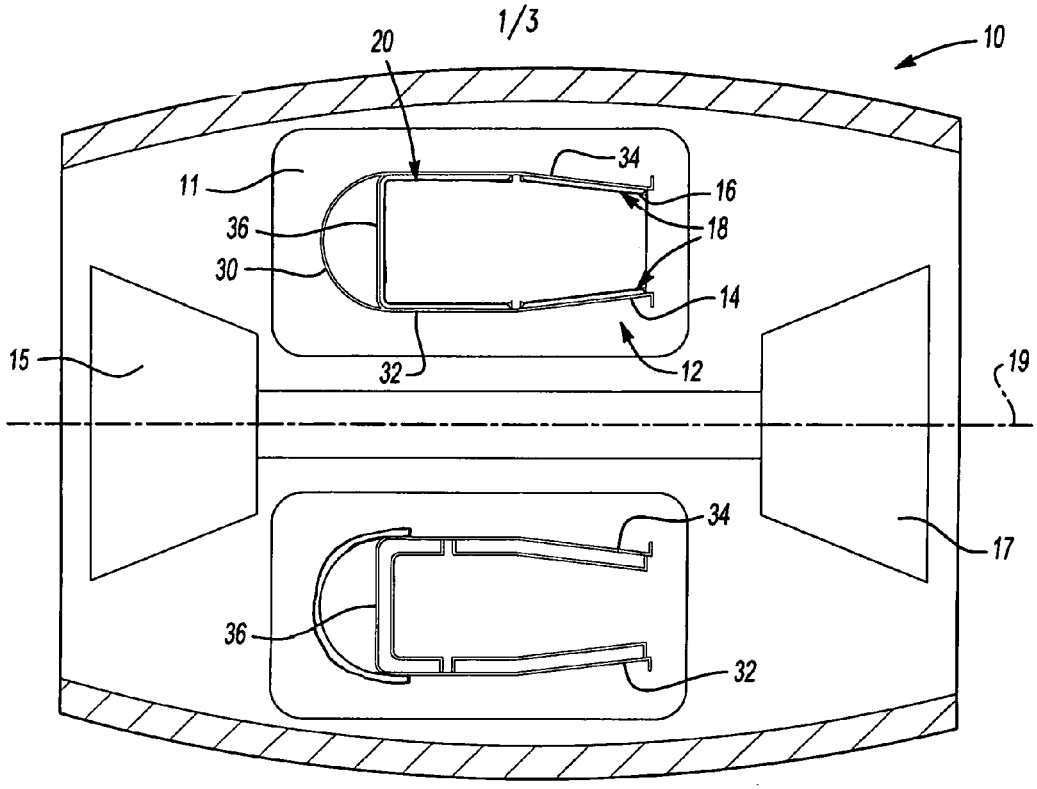
FIG. 1 is a cross-sectional view of a gas turbine engine including an example combustor liner assembly according to this invention.

Referring to FIG. 1, a gas turbine engine assembly 10 includes a compressor 15 that feeds compressed air to a combustor assembly 11. The combustor assembly 11 ignites a fuel air mixture to produce combustion gases that drive a turbine 17. The combustor assembly 11 includes a dual wall liner assembly 12. The liner assembly 12 includes an outer shell 14 supporting a plurality of inner heat shields 16. The inner heat shields 16 include a hot side 18 that defines a gas flow path, and a cold side 20 that faces the outer shell 14. The outer shell 14 is made of a ceramic matrix composite and the inner heat shields 16 are made of a material other than the ceramic matrix composite that is compatible with the ceramic matrix composite and that is capable of withstanding the high temperatures generated by combustion and burning of gases.

The outer shell 14 is shown in an annular configuration about an axis 19 of the turbine engine 10. The liner assembly 12 includes an outer radial wall 34 and an inner radial wall 32. The outer shell 14 also includes a cowling 30 that is disposed forward of a forward end segment 36. The cowling 30 directs airflow around the combustor 1. The forward end segment 36 provides for the securement of a heat shield 16 on a forward end of the combustor 11. As should be appreciated, the gas turbine engine 10 illustrated in FIG. 1 is a schematic drawing and represents only one example of a turbine engine configuration that will benefit from the disclosures of this invention. It is within the contemplation of this invention that the combustor liner assembly 12 may be used for other combustor configurations, for example, a can type combustor or any combination of an annular or can combustor.

Figure 2:
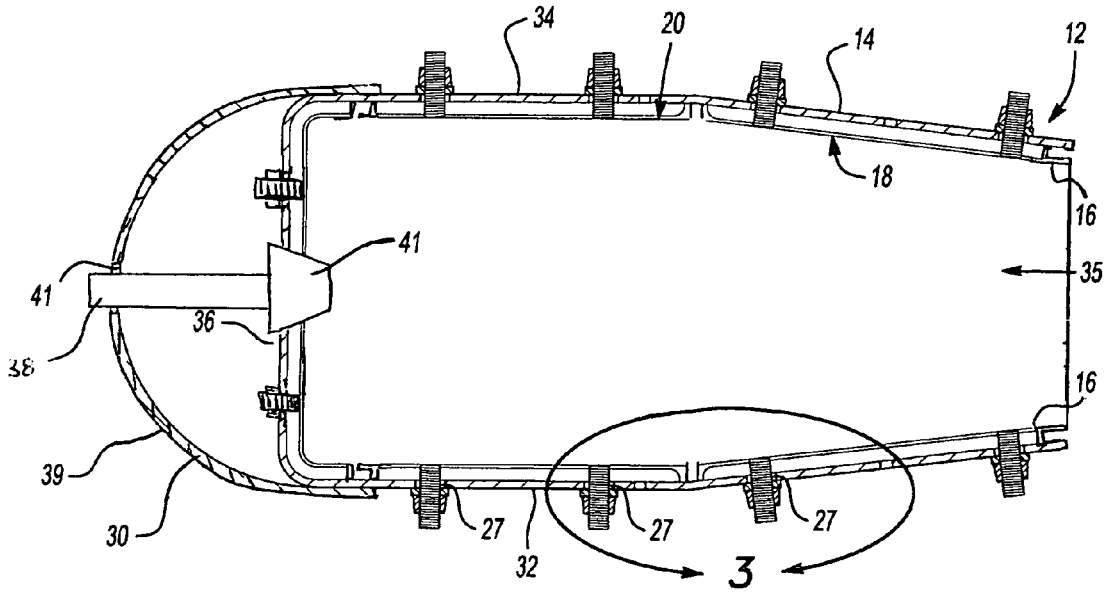
FIG. 2 is a cross-sectional view of the example combustor liner assembly according to this invention.

Referring to FIG. 2, a section of the combustion liner assembly 12 is illustrated and includes the outer shell 14 along with a plurality of inner heat shields 16. The inner heat shields 16 define the hot side surface 18. The hot side surface 18 defines a flow path for combustion gasses generated within the combustor assembly 11. The outer shell 14 includes the cowling 30 that is a radial portion on a first end of the liner assembly 12. The cowling 30 does not define an internal configuration of the combustor assembly 11. The cowling 30, and the forward end wall include openings 41 for a fuel nozzle 38. The position of the fuel nozzle 38 is schematically shown to illustrate a general location and orientation. As appreciated, the fuel nozzle 38 would be arranged as is know in the art to optimize combustion.

The plurality of heat shields 16 are fastened by way of fasteners 26 to the outer shell 14. The outer shell 14 includes a plurality of openings 25 that correspond to fasteners 26. The outer shell 14 is made of a ceramic matrix composite that provides desirable thermal properties. The ceramic matrix composite may be of any composition known to a worker skilled in the art. For example, the ceramic matrix composite may include a silicon-based composition including silicon carbide, silicon nitride or oxide-based ceramic materials. A worker skilled in the art would understand the composition of the ceramic matrix material favorable for application specific requirements.

The ceramic matrix composite material provides desirable thermal properties, but is not desirable in applications and environments that encounter thermal loading caused by thermal gradients as are present within a combustor. However, although the outer shell 14 of this invention encounters high temperatures, the heating is relatively even such that high amounts of thermal loading are not placed on the ceramic matrix composite material.

The heat shields 16 are supported by the ceramic matrix composite outer shell 14 and are made of material possessing favorable thermal mechanical properties compatible with the high thermal gradients encountered within the combustor assembly 11. The inner heat shields 16 are constructed of a refractory alloy or other advanced alloy composition that is compatible with the ceramic matrix composite of the outer shell 14. A worker skilled in the art would understand and know what materials are chemically and thermally compatible for use with the specific ceramic matrix composite and that also provide the desired thermal mechanical properties.

A plurality of fasteners 26 is utilized to secure the heat shields 16 within the outer shell 14. The fasteners 26 may be separate elements or may be integrally formed with the inner heat shields 16. The configuration of the combustor liner assembly 12 is shown with a convergent portion extending from the forward end segment 36 towards an aft open end 35. The specific shape of the combustor liner assembly 12 is application specific and other configurations and orientations of the combustor liner assembly 12 are within the contemplation of this invention.

Figure 3:
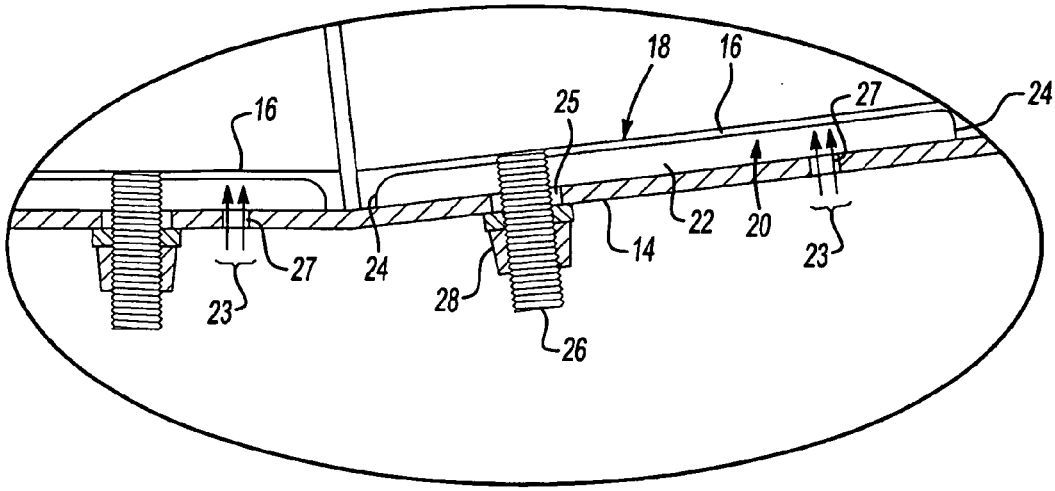
FIG. 3 is an enlarged cross-sectional view of an example liner assembly according to this invention.

Referring to FIG. 3, the inner heat shields 16 are attached by way of the fasteners 26 to the outer shell 14. The inner heat shields 16 include several panels that are attached to the outer shell 14 to define the hot side 18 and the flow surface for the combustion gases. The plurality of inner heat shields 16 include tab portions 24 that space the inner heat shields 16 and specifically the hot side 18 a desired distance away from the outer shell 14. This provides and defines a cooling air passage 22 between the inner heat shields 16 and the outer shell 14. The cooling air passage 22 provides for cooling airflow against a cool side 20 of the inner heat shields 16. Further, the outer shell 14 may also includes impingement openings 27 that provide for cooling air flow 23 to strike directly against the inner heat shield 16 in desired locations.

Each of the fasteners 26 includes a corresponding threaded member 28. The fasteners 26 extend through openings 25 within the outer shell 14 and are secured by the threaded member 28. The fastener 26 shown in FIG. 3 is an integral part of the inner heat shield 16. However, the fasteners 26 may also comprise an additional element separate from both the inner heat shield 16 and the outer shell 14.

The inner heat shields 16 comprise a plurality of panels that are fit and mounted to the inner surface of the outer shell 14. The inner heat shields 16 are supported within the outer shell 14 and are spaced apart from the outer shell by the tab 24. As appreciated, although a tab 24 is shown other spacers as are understood and within one skilled in the art maybe utilized to define a space between the inner heat shield 16 and the outer shell 14.

Figure 4:
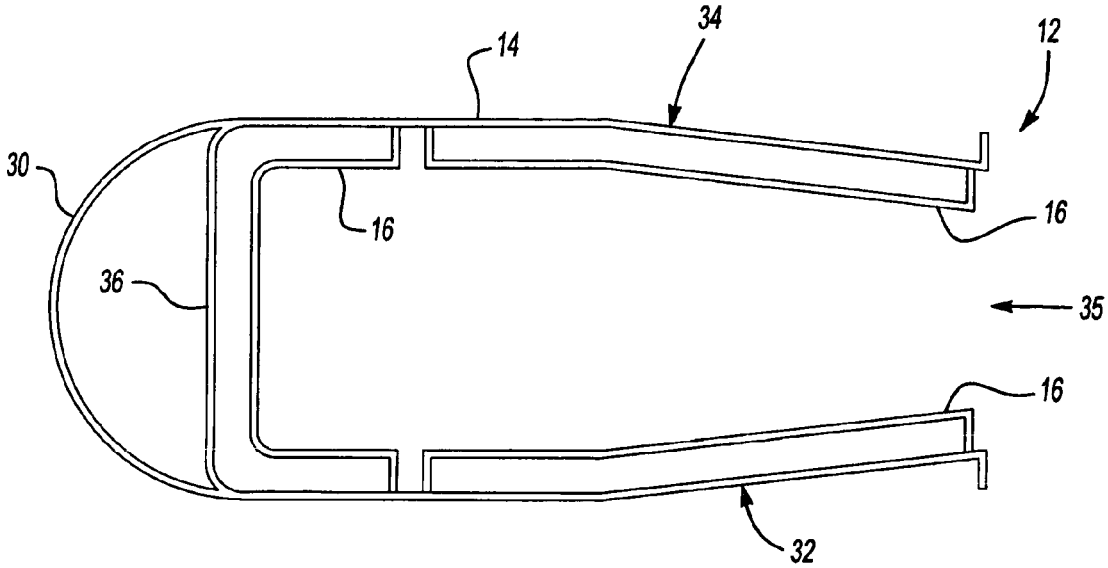
FIG. 4 is a schematic view of another example liner assembly according to this invention.

Referring to FIG. 4, the combustor liner assembly 12 is shown schematically with the plurality of inner shields 16 attached within the outer shell 14. The outer shell 14 illustrated is formed as a single piece. The outer shell 14 includes one piece that forms the inner radial wall 32, the outer radial wall 34, the forward end segment 36 and the cowling 30.

Figure 5:
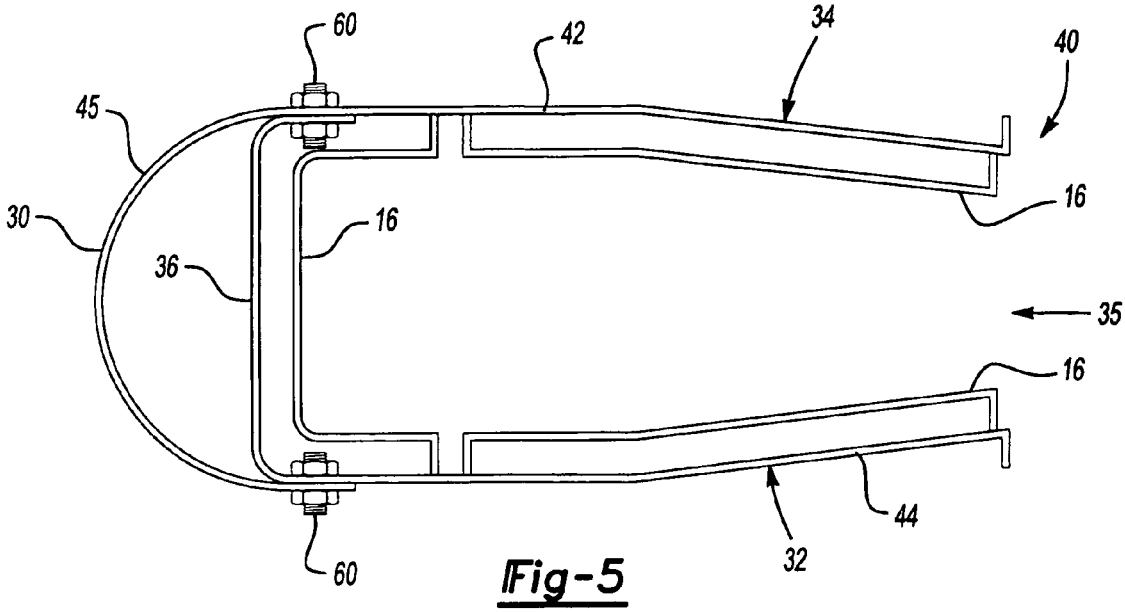
FIG. 5 is a schematic view of another example liner assembly according to this invention.

Referring to FIG. 5, another liner assembly 40 according to this invention includes a two-piece outer shell 45. The outer shell 45 is comprised of a first portion 42 that includes the cowling 30 and a second portion 44 that includes the first end segment 36 along with an inner radial wall 32. The first portion 42 is attached to the second portion 44 by fasteners or other fastening means to form the complete outer shell 45. The second portion 44 is fit within the first portion 42 in an overlapping manner to define a desired combustor liner shape. The first portion 42 is attached to the second portion 44 by fasteners 60. The fasteners 60 may comprise any fastener as is know to a worker skilled in the art.

Figure 6:
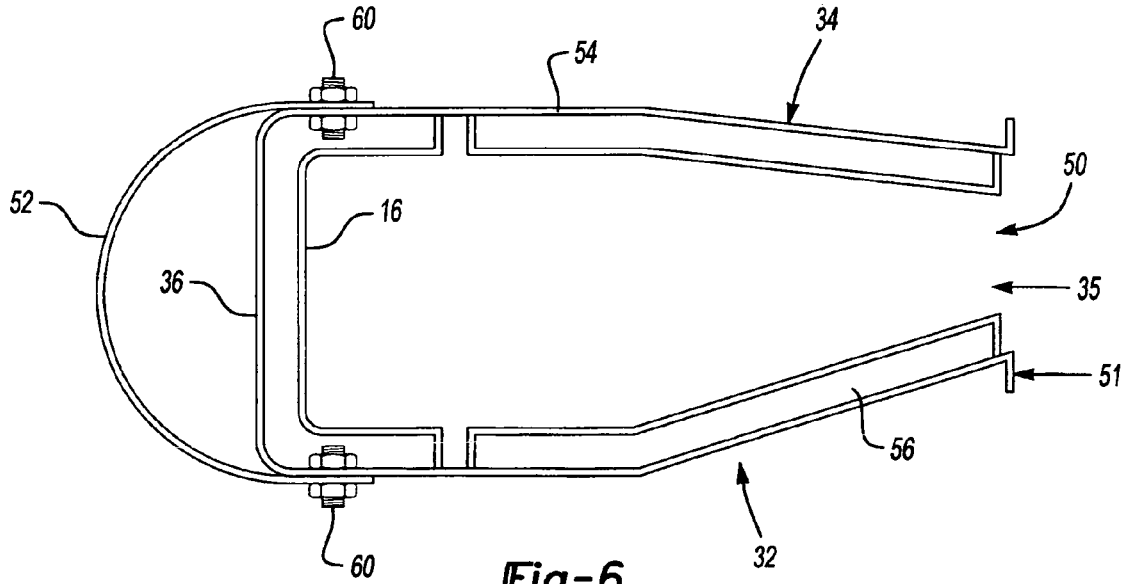
FIG. 6 is a schematic view of another example line assembly according to this invention.

Referring to FIG. 6, another combustor liner assembly according to this invention is generally indicated at 50 and includes and outer shell 51 comprising a cowling 52, a second segment 54 that defines the outer radial wall 34, the forward end segment 36, and a third segment 56 that defines the inner radial wall 32. Each of the portions of the outer shell 14 are mechanically attached by fasteners 60. The cowling 52 is not necessarily formed from the ceramic matrix composite, and may be formed from another material such as a metal alloy, or other suitable materials as is known to a worker skilled in the art. Once the outer shell 51 is defined, the inner heat shields 16 are attached as required to define the inner hot side surface 18 that contacts the hot combustion gasses.

A combustor liner assembly 12 according to this invention utilizes the favorable thermal properties of a ceramic matrix composite without exposure to thermal gradients. Attachment of the heat shields 16 to the outer shell 14 through openings in the ceramic matrix composite provides a durable and desirable combination that utilizes thermally and mechanically desirable materials.

The foregoing description is exemplary and not just a material specification. Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A gas turbine combustor liner assembly comprising:

an outer shell made of a ceramic composite and defining a combustion chamber, the outer shell including a forward end segment and an open end; and an inner heat shield supported within the outer shell defining a surface exposed to spatially non-uniform temperature, the inner heat shield spaced apart from the outer shell and extending from the forward segment to the open end of the outer shell to shield the outer shell from direct exposure to hot gases, wherein the inner heat shield is made of a material other than the ceramic composite comprising the outer shell.

2. The assembly as recited in claim 1, wherein the outer shell includes a plurality of mounting openings and a corresponding plurality of fasteners within the plurality of mounting openings for securing the inner heat shield within the outer shell.

3. The assembly as recited in claim 2, wherein the plurality of fasteners space the inner heat shield a distance from an inner surface of the outer shell.

4. The assembly as recited in claim 2, wherein the plurality of fasteners comprises a part separate from the outer shell and the inner heat shield.

5. The assembly as recited in claim 2, wherein the inner heat shield comprises at least some of the plurality of fasteners.

6. The assembly as recited in claim 1, including a cowling disposed on an outer surface of the liner assembly.

7. The assembly as recited in claim 6, wherein the outer shell includes a first segment forming a portion of the cowling and a second segment attached to the first segment.

8. The assembly as recited in claim 6, wherein the outer shell includes a first segment forming the cowling, a second segment forming an outer side of the outer shell and a third segment forming an inner side of the outer shell.

9. The assembly as recited in claim 6, wherein the cowling is made from a material other than the ceramic composite.

10. The assembly as recited in claim 1, wherein the inner heat shield comprises a plurality of panels supported by the outer shell.

11. The assembly as recited in claim 1, including a passage for cooling air defined between the outer shell and the inner heat shield.

12. The assembly as recited in claim 1, including impingement cooling openings within the outer shell for directing air against an outer surface of the inner heat shield.

13. The assembly as recited in claim 1, wherein the combustor liner assembly is annular.

14. The assembly as recited in claim 1, wherein the liner assembly is assembled within a can combustor.

15. The assembly as recited in claim 1, wherein the outer shell is made from a ceramic matrix composite.

* * * * *

UNITED STATES PATENT AND TRADEMARK OFFICE

CERTIFICATE OF CORRECTION

PATENT NO. : 7,665,307 B2
APPLICATION NO. : 11/316657
DATED : February 23, 2010
INVENTOR(S) : Burd et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 989 days.

Signed and Sealed this

Fourth Day of January, 2011

David J. Kappos

David J. Kappos
*Director of the United States Patent and Trademark Office*